US009926113B2

(12) United States Patent
Shek

(10) Patent No.: US 9,926,113 B2
(45) Date of Patent: Mar. 27, 2018

(54) CONTAINER

(71) Applicant: Michael Shek, San Mateo, CA (US)

(72) Inventor: Michael Shek, San Mateo, CA (US)

( * ) Notice: Subject to any disclaimer, the term of this patent is extended or adjusted under 35 U.S.C. 154(b) by 166 days.

(21) Appl. No.: 15/149,345

(22) Filed: May 9, 2016

(65) Prior Publication Data

US 2017/0320639 A1 Nov. 9, 2017

(51) Int. Cl.
*B65D 43/26* (2006.01)
*B65D 43/16* (2006.01)

(52) U.S. Cl.
CPC ..... *B65D 43/26* (2013.01); *B65D 43/16* (2013.01)

(58) Field of Classification Search
CPC ..... B65D 43/26
See application file for complete search history.

(56) References Cited

U.S. PATENT DOCUMENTS 8,519,646 B2 * 8/2013 Lin ..... B65F 1/1638 318/14

FOREIGN PATENT DOCUMENTS

TW M446772 2/2013

* cited by examiner

*Primary Examiner* — David S Luo
(74) *Attorney, Agent, or Firm* — Muncy, Geissler, Olds & Lowe, P.C.

(57) ABSTRACT

A container is provided. A main body has a barrel body and a cover body, the cover body is normally in a first position and optionally movable to a second position. An electronic processing unit is arranged on the main body. A sensing device, a power connecting device and a driving device are arranged on the main body and electrically connected to the electronic processing unit. When the cover body is in the first position, the cover body covers the placement opening, the cover body and the barrel body are in a fixed relative position; and when the cover body is in the second position, the cover body is remote from the placement opening. When the cover body receives an external force to move away from the barrel body, the driving device actuates the cover body to move from the first position to the second position.

10 Claims, 8 Drawing Sheets

CONTAINER

BACKGROUND OF THE INVENTION

Field of the Invention

The present invention relates to a container.

Description of the Prior Art

A cover body of a conventional container needs to be opened manually, so hands of a user may get dirty easily. The industry develops an infrared sensing way to actuate a driving device to move the cover body so that the cover body can be automatically lifted. This type of container is disclosed in TWM446772.

However, in this type of prior art, the container with infrared sensing can detect through a light sensor to know if the hands of the user approach, so the container consumes electricity all the time. In addition, the light sensor can only sense objects from a certain direction, the hands of the user must move and face the light sensor so as to actuate the light sensor.

The present invention has arisen to mitigate and/or obviate the afore-described disadvantages.

SUMMARY OF THE INVENTION

The major object of the present invention is to provide container which can assist a cover body to open automatically and provides a preferable sensing method to effectively save an energy consumed.

To achieve the above and other objects, a container is provided, including a main body, an electronic processing unit, a sensing device, a power connecting device and a driving device. The main body has a barrel body and a cover body connected to the barrel body, the barrel body has a placement opening, the cover body is normally located in a first position and optionally movable to the second position; the electronic processing unit is arranged on the main body; the sensing device is arranged on the main body and electrically connected to the electronic processing unit; the power connecting device is arranged on the main body and electrically connected to the electronic processing unit; the driving device is arranged on the main body and electrically connected to the electronic processing unit, the driving device is controllable in response to a signal of the electronic processing unit to actuate the cover body to move; wherein when the cover body is in the first position, the cover body covers the placement opening, the cover body and the barrel body are kept in a fixed relative position, and the sensing device is in a first state; when the cover body is in the second position, the cover body is remote from the placement opening, and the sensing device is off the first state; wherein when the cover body receives an external force to move away from the barrel body, the sensing device changes from the first state, the sensing device transmits an electronic signal to the electronic processing unit, and the electronic processing unit drives the driving device to actuate the cover body to move from the first position to the second position.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
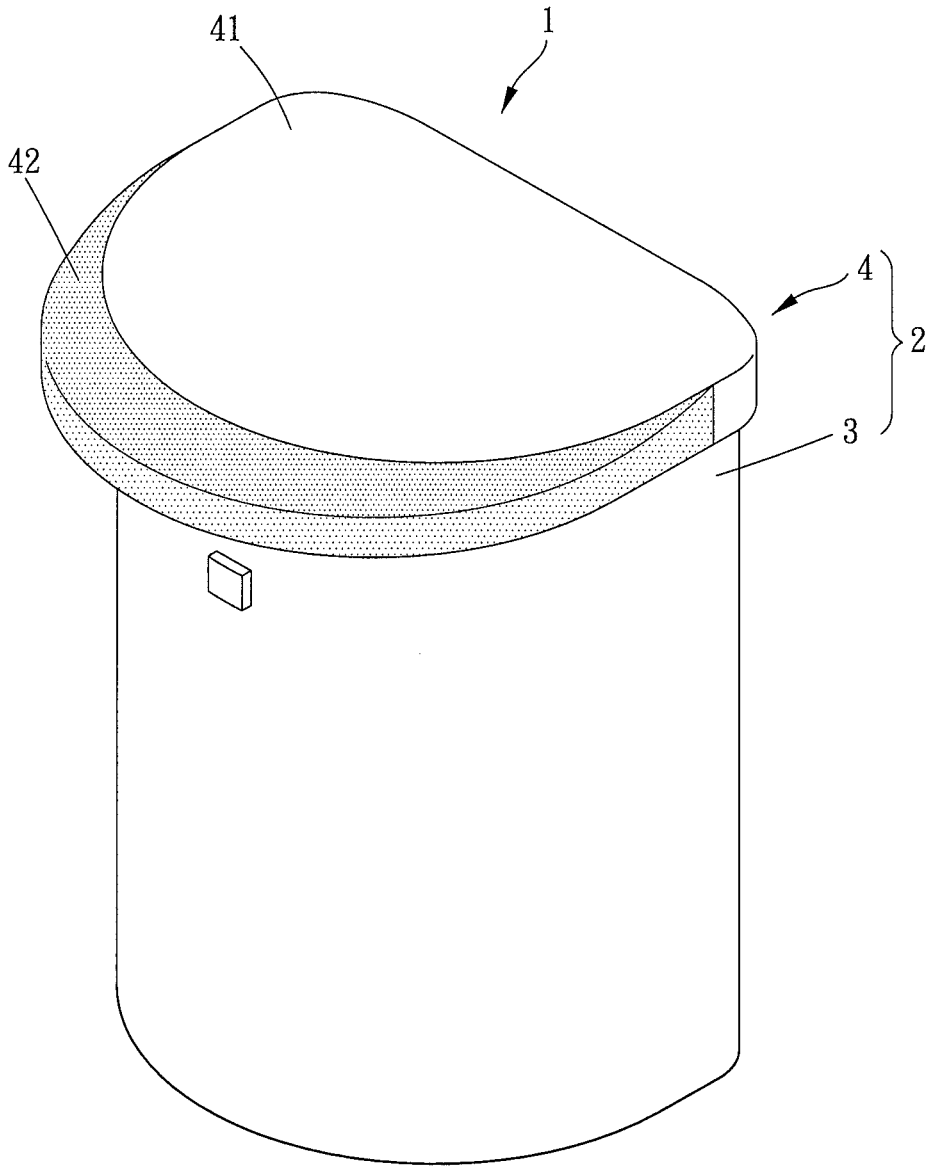
FIG. 1 is a stereogram of a preferred embodiment of the present invention.
Figure 2:
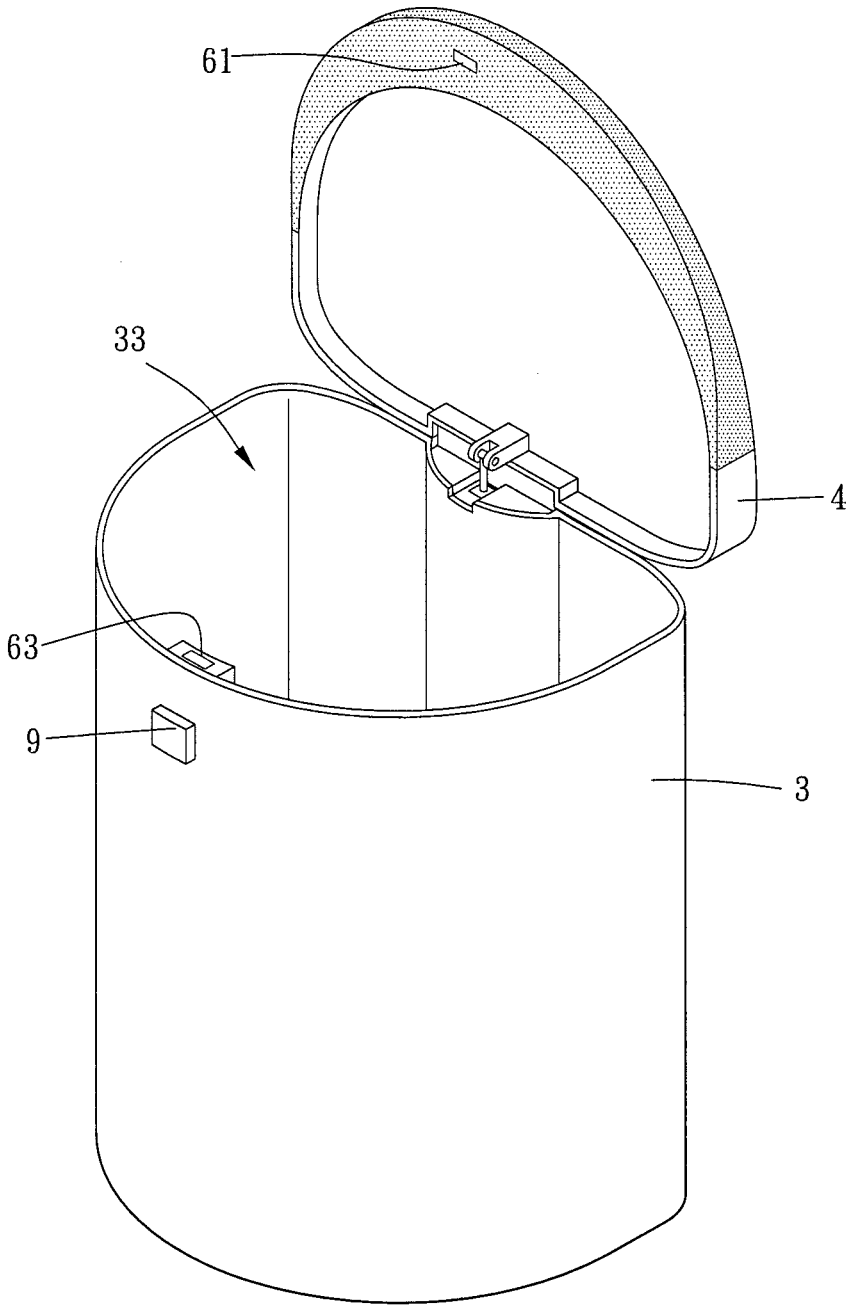
FIG. 2 is another stereogram of the preferred embodiment of the present invention.
Figure 3:
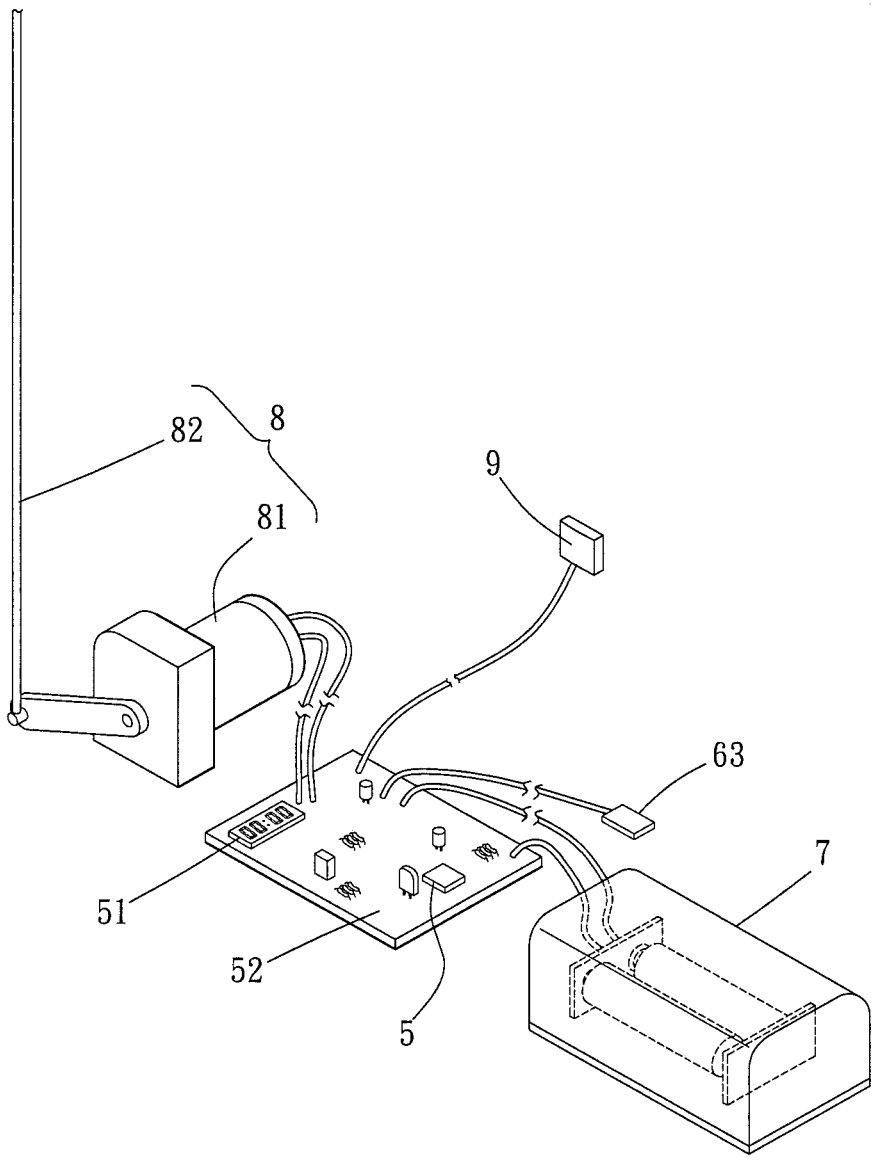
FIG. 3 is an assembly view of a part of elements of the preferred embodiment of the present invention.

The present invention will be clearer from the following description when viewed together with the accompanying drawings, which show, for purpose of illustrations only, the preferred embodiment in accordance with the present invention.

Please refer to FIGS. 1 to 5 for a preferred embodiment of the present invention. A container 1 includes a main body 2, an electronic processing unit 5, a sensing device 6, a power connecting device 7 and a driving device 8.

The main body 2 has a barrel body 3 and a cover body 4 connected to the barrel body 3, the barrel body 3 has a placement opening 33, the cover body 4 is normally located in a first position and optionally movable to a second position; the electronic processing unit 5 is arranged on the main body 2; the sensing device 6 is arranged on the main body 2 and electrically connected to the electronic processing unit 5; the power connecting device 7 is arranged on the main body 2 and electrically connected to the electronic processing unit 5; the driving device 8 is arranged on the main body 2 and electrically connected to the electronic processing unit 5, the driving device 8 is controllable in response to a signal of the electronic processing unit 5 to actuate the cover body 4 to move. It is to be noted that in this embodiment, the main body 2 is a garbage container but not limited thereto; but in other embodiments, the main body may be a facial tissue box, jewelry box, or others.

Figure 4:
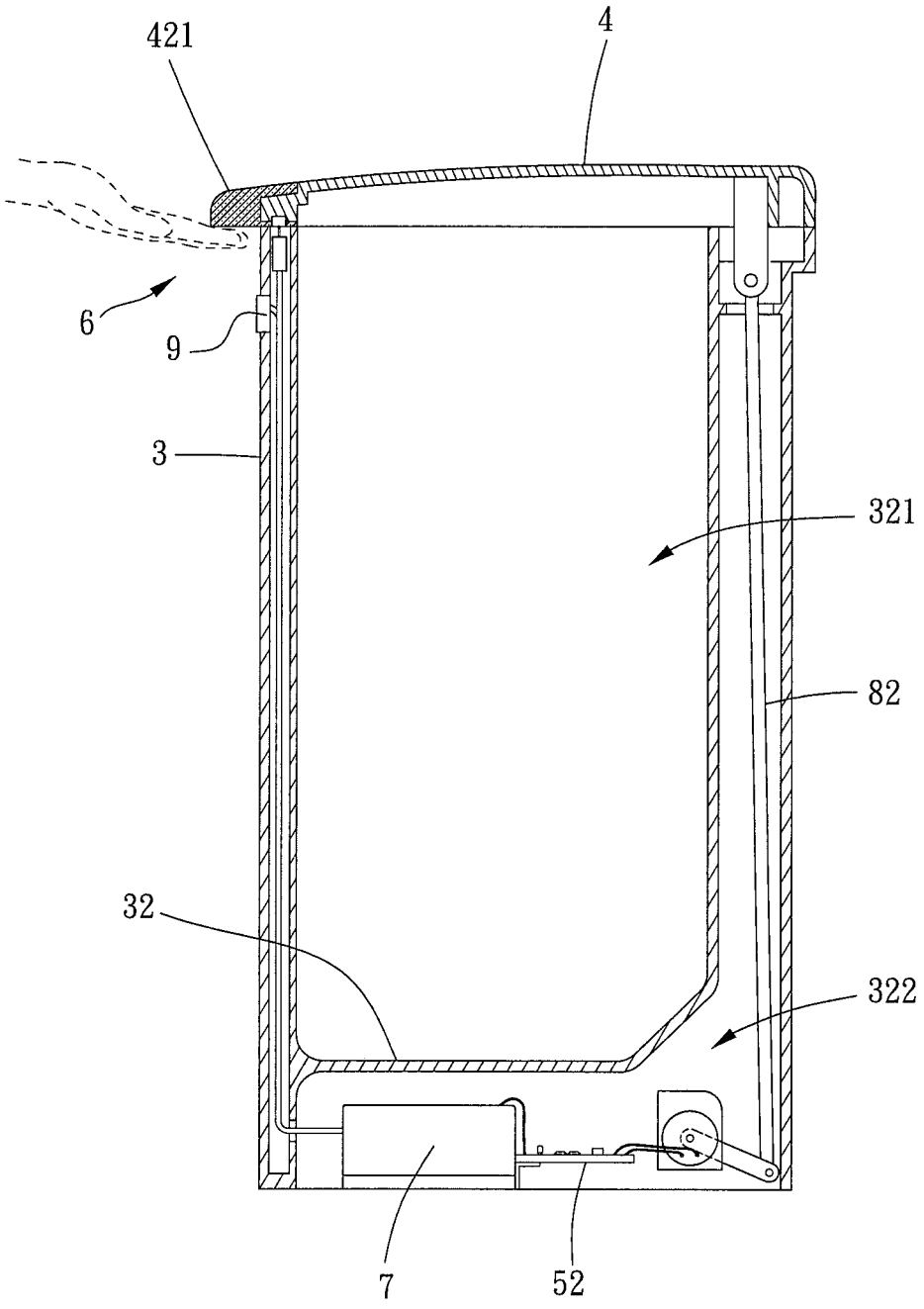
FIG. 4 is a side cross-sectional view of FIG. 1.
Figure 5:
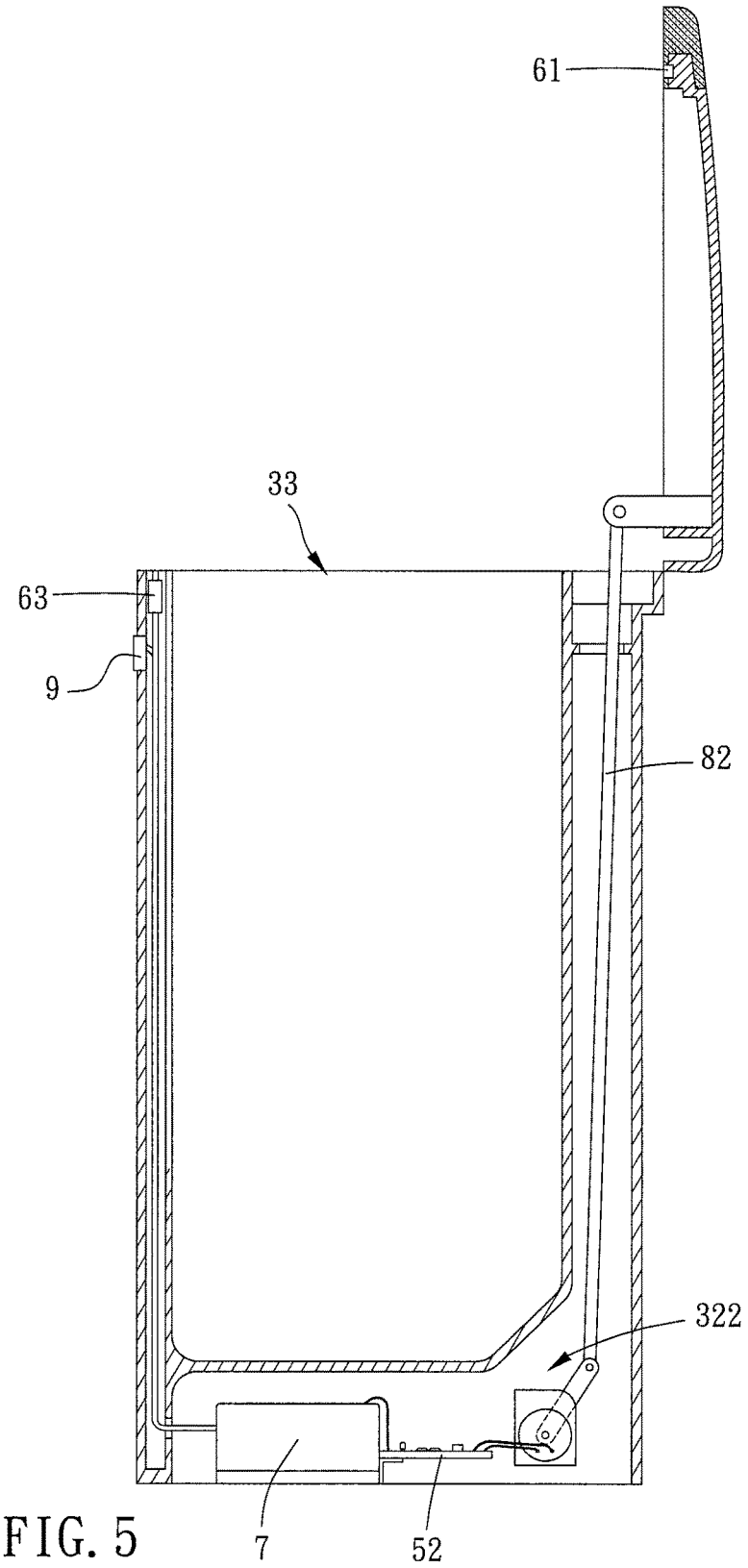
FIG. 5 is a side cross-sectional view of FIG. 2.

Specifically, the sensing device 6 has a first magnetically attractable portion 61 and a magnetic sensor 63, one of the first magnetically attractable portion 61 and the magnetic sensor 63 is arranged on the barrel body 3, and the other of the first magnetically attractable portion 61 and the magnetic sensor 63 is arranged on the cover body 4, and the magnetic sensor 6 is electrically connected to the electronic processing unit 5. In this embodiment, the cover body 4 is provided with one said first magnetically attractable portion 61, and the barrel body 3 is provided with one said magnetic sensor 63. More specifically, the barrel body 3 further includes a partition member 32, the partition member 32 partitions an interior of the barrel body 3 into a first space 321 and a second space 322 (as shown in FIGS. 4 and 5), the first space 321 communicates with the placement opening 33, the magnetic sensor 63, the electronic processing unit 5, the power connecting device 7 and the driving device 8 are received in the second space 322, and the first space 321 is between the cover body 4 and the second space 322. The power connecting device 7 is a battery box, and through assembling batteries thereto, the power connecting device 7 can provide power at any time. In other embodiments, the power connecting device 7 may be a power wire set.

Furthermore, the sensing device may be a micro switch for detecting opening or closing of the cover body 4.

In addition, when the cover body 4 is in the first position, the cover body 4 covers the placement opening 33, the cover body 4 and the barrel body 3 are kept in a fixed relative position, the sensing device 6 is in a first state, and when the cover body 4 is in the second position, the cover body 4 is remote from the placement opening 33, and the sensing device 6 is off the first state. When the cover body 4 receives an external force to move away from the barrel body 3, for example, when a user lifts the cover body 4 with hands, the sensing device 6 changes from the first state, the sensing device 6 transmits an electronic signal to the electronic processing unit 5, and the electronic processing unit 5 drives the driving device 8 to actuate the cover body 4 to move from the first position to the second position so as to assist the cover body 4 to complete the automatic lifting movement. Through the sensing method, the cover body 4 can be actuated to open from a non-specific direction.

Furthermore, it is to be noted that this embodiment adopts a detection method of magnetically attractable sensing. Therefore, when the cover body 4 is in the first position, the magnetic sensor 63 is near the first magnetically attractable portion 61, and the magnetic sensor 63 and the first magnetically attractable portion 61 are in the first state. It is to be noted that the magnetic sensor 63 is small, light and highly sensitive. In addition, compared with other sensors with other sensing methods (for example, infrared sensing), the magnetic sensor 63 requires less electricity, so the service life of the battery can be effectively prolonged.

Specifically, the driving device 8 includes a motor 81 and a connecting member 82, the motor 81 is electrically connected to the electronic processing unit 5, and the connecting member 82 is connected to the motor 81 and the cover body 4. When the magnetic sensor 63 and the first magnetically attractable portion 61 (that is, the sensing device 6) change from the first state, the motor 81 drives the connecting member 82 to move toward the placement opening 33, the cover body 4 swings relative to the barrel body 3 with a side of the cover body 4 connected to the connecting member 82 as an rotation axle, and the cover body 4 is lifted and moved to the second position.

Preferably, the cover body 4 has a base 41 and a touching portion 42, the touching portion 42 is connected to the base 41 and for receiving the external force, the touching portion 42 allows the user to distinctively know that a preferable touching position so that the magnetic sensor 63 and the first magnetically attractable portion 61 (that is, the sensing device 6) change from the first state. More preferably, the touching portion 42 is detachably connected to the base 41 and has a washable layer 421, and the washable layer 421 may be, for example, a rubber layer, but not limited thereto. Therefore, it is convenient to clean the touching portion 42. In this embodiment, the touching portion 42 is substantially C-shaped, and at least a part of the touching portion 42 protrudes radially beyond the barrel body 3 for the user to touch with hands.

Figure 6:
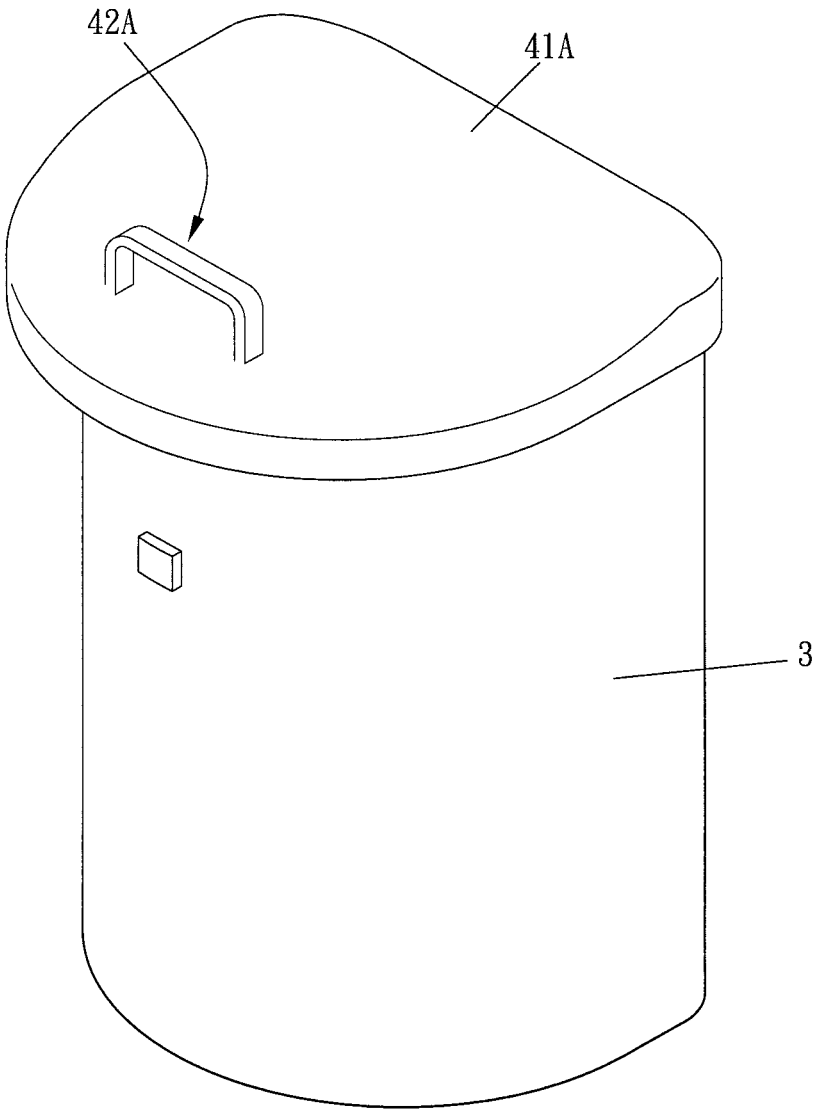
FIG. 6 is a stereogram of another preferred embodiment of the present invention.
Figure 7:
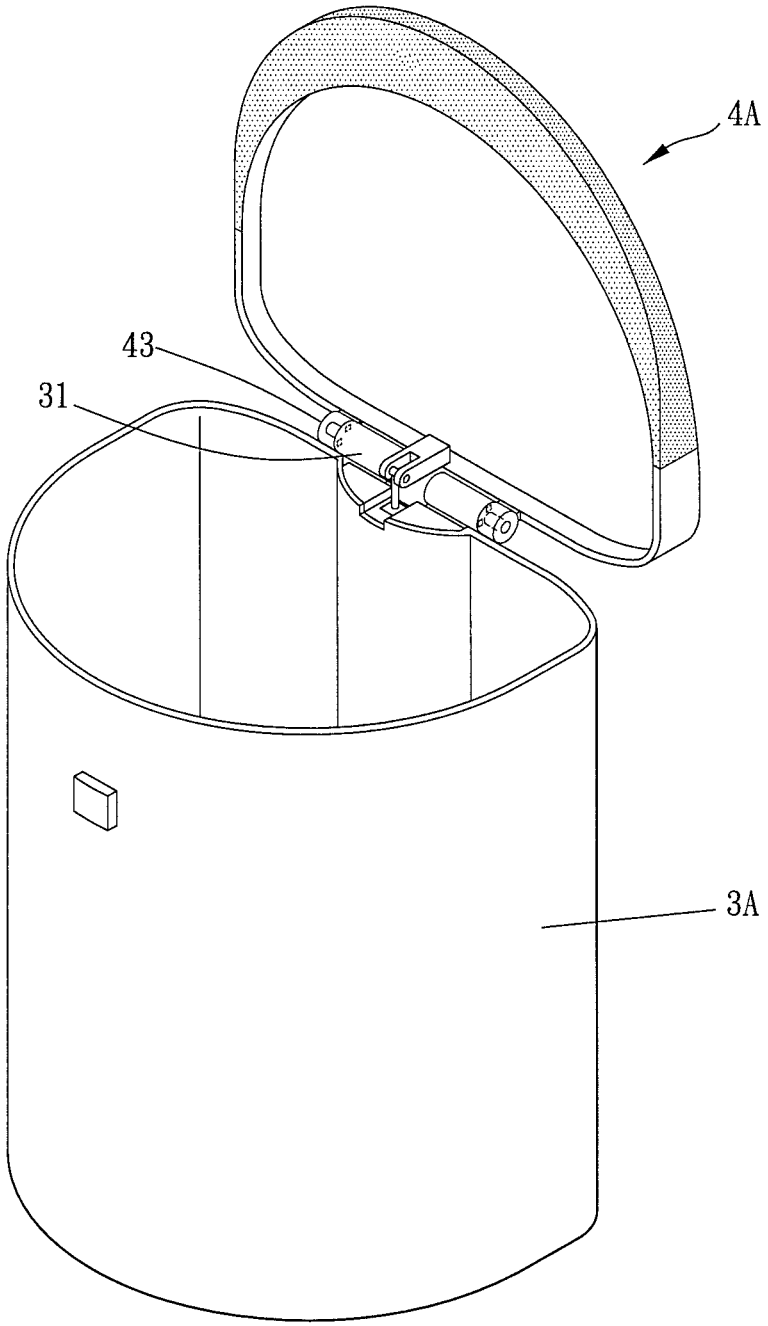
FIG. 7 is a stereogram of still another preferred embodiment of the present invention.
Figure 8:
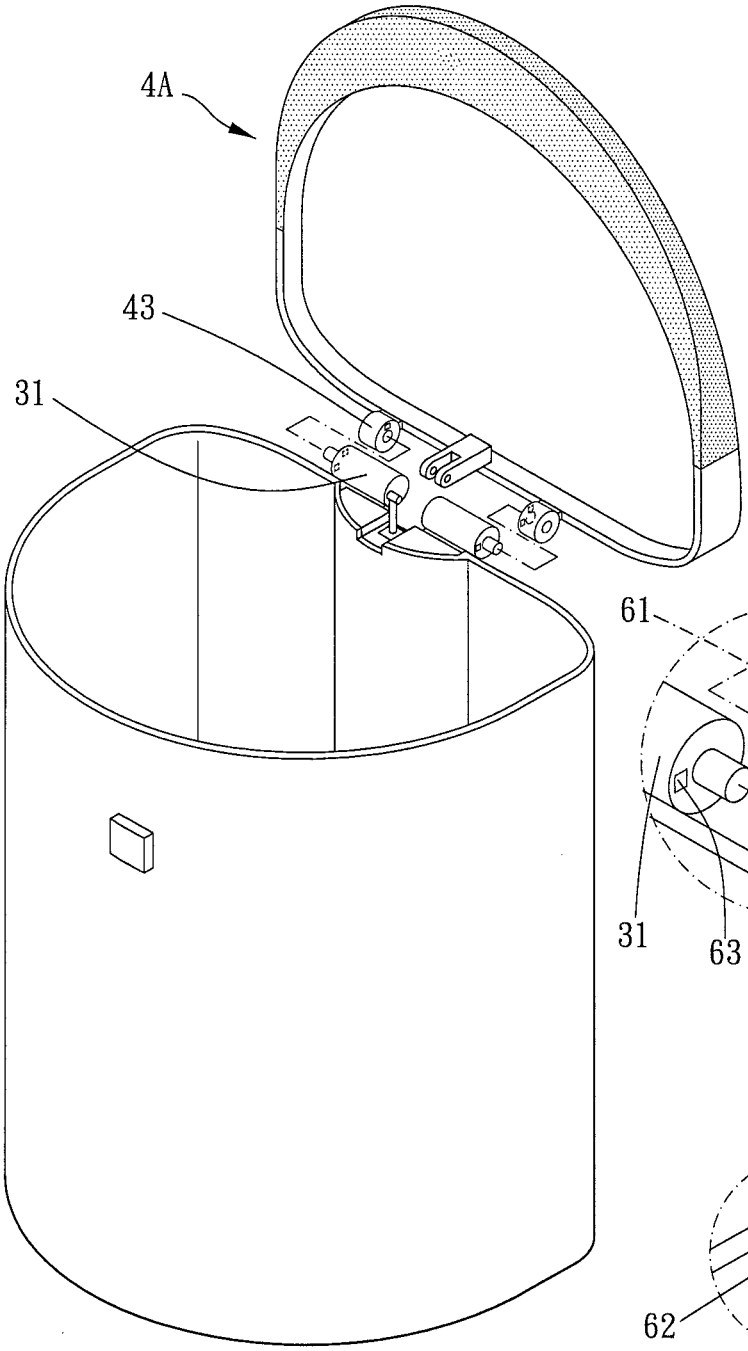
FIG. 8 is a partial perspective view of FIG. 7.

However, in other embodiments, the touching portion 42 may be in other modes according to various requirements. For example, as shown in another embodiment of FIG. 6, the touching portion 42A is a handle, and the base 41A is between the touching portion 42A and the barrel body 3.

Please refer to FIGS. 1 to 5 for this embodiment, the container 1 further includes a timer 51 which is electrically connected to the electronic processing unit 5, and the timer 51 is preset with a predetermined period. In this embodiment, the predetermined period is 5 seconds, and the timer 51 and the electronic processing unit 5 are electrically connected to a circuit board 52. When the cover body 4 is in the second position, the timer 51 starts to count, and when the timer 51 reaches the predetermined period, the electronic processing unit 5 drives the driving device 8 to actuate the cover body 4 to move from the second position to the first position. In other words, the cover body 4 can cover the placement opening 33 automatically, and the cover body 4 can close slowly so as to decrease the noise of collision with the barrel body 3.

Preferably, the container 1 further includes a time adjusting member 9 which is for being operated from outside, the time adjusting member 9 is arranged on the main body 2 and electrically connected to the electronic processing unit 5, and when the time adjusting member 9 is actuated, the electronic processing unit 5 changes the predetermined period. For example (but not limited thereto), the time adjusting member 9 may be designed in a way that the user can change the predetermined period, or when the time adjusting member 9 is actuated, the predetermined period is prolonged, for example, from 5 seconds to 2 minutes.

It is understandable that the cover body 4 can be controlled to move from the second position to the first position in other ways. Please refer to FIGS. 7 to 10 for still another embodiment, the cover body 4A is pivoted to the barrel body 3A, and the sensing device 6A further has a second magnetically attractable portion 62. When the cover body 4A is in the second position, the cover body 4A and the barrel body 3A are kept in a fixed relative position, the magnetic sensor 63 is near the second magnetically attractable portion 62, and the magnetic sensor 63 and the second magnetically attractable portion 62 are in a second state. When the cover body 4A receives an external force to move toward the barrel body 3A, for example, when the user presses the cover body 4A with hands, the magnetic sensor 63 and the second magnetically attractable portion 62 change from the second state, the magnetic sensor 63 transmits an electronic signal to the electronic processing unit 5, and the electronic processing unit 5 drives the driving device 8 to actuate the cover body 4A to move from the second position to the first position. In other words, the user can decide when the cover body 4 covers the barrel body 3A in accordance with his/her needs.

Figure 9:
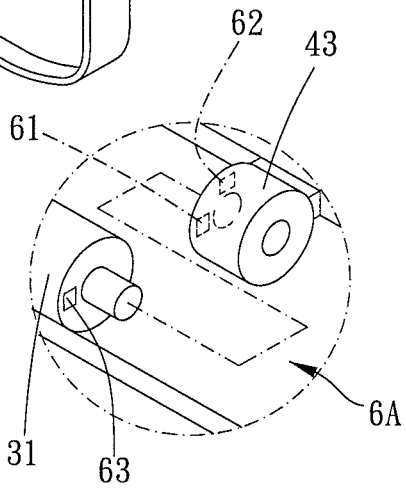
FIG. 9 is a partially-enlarged view of FIG. 8.
Figure 10:
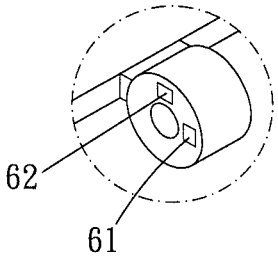
FIG. 10 is an enlarged view of a pivot portion of FIG. 8.

Specifically, one of the cover body 4A and the barrel body 3A includes at least one pivot portion 43, the other of the cover body 4A and the barrel body 3A includes at least one axle 31, the at least one pivot portion 43 and the at least one axle 31 are pivoted to each other, at least one said pivot portion 43 has the first and second magnetically attractable portions 61, 62, and the magnetic sensor 63 is disposed on one of the at least one axle 31 and corresponds to the first and second magnetically attractable portions 61, 62 (as shown in FIG. 9). In this embodiment, the cover body 4A is provided with two said pivot portions 43 symmetrical to each other, and the barrel body 3A is provided with two said axles 31 symmetrical to each other, each said pivot portion 43 has the first and second magnetically attractable portions 61, 62, and each said axle 31 is provided with the magnetic sensor 63. In other embodiments, the first and second magnetically attractable portions 61, 62 may be arranged opposite to the magnetic sensor 63.

Given the above, in the container, through magnetically attractable sensing method, the electronic signal is produced to actuate the driving device to move the cover body so as to lift the cover body automatically. When the first state is changed, the cover body can be lifted without limitation of specific sensing directions. In addition, the electricity that the magnetic sensor needs is small; therefore, when the battery is served as a power source, the battery has a preferable service life. In addition, the touching portion can be disassembled and washable.

While we have shown and described various embodiments in accordance with the present invention, it should be clear to those skilled in the art that further embodiments may be made without departing from the scope of the present invention.

What is claimed is:

1. A container, including:

a main body, having a barrel body and a cover body connected to the barrel body, the barrel body having a placement opening, the cover body normally located in a first position and being optionally movable to a second position;

an electronic processing unit, arranged on the main body;

a sensing device, arranged on the main body and electrically connected to the electronic processing unit;

a power connecting device, arranged on the main body and electrically connected to the electronic processing unit;

a driving device, arranged on the main body and electrically connected to the electronic processing unit, the driving device controllable in response to a signal of the electronic processing unit to actuate the cover body to move;

wherein when the cover body is in the first position, the cover body covers the placement opening, the cover body and the barrel body are kept in a fixed relative position, and the sensing device is in a first state; when the cover body is in the second position, the cover body is remote from the placement opening, and the sensing device is off the first state;

wherein when the cover body receives an external force to move away from the barrel body, the sensing device changes from the first state, the sensing device transmits an electronic signal to the electronic processing unit, and the electronic processing unit drives the driving device to actuate the cover body to move from the first position to the second position.

2. The container of claim 1, wherein the sensing device has a first magnetically attractable portion and a magnetic sensor, one of the first magnetically attractable portion and the magnetic sensor is arranged on the barrel body, the other of the first magnetically attractable portion and the magnetic sensor is arranged on the cover body, the magnetic sensor is electrically connected to the electronic processing unit; wherein when the cover body is in the first position, the magnetic sensor is near the first magnetically attractable portion, and the magnetic sensor and the first magnetically attractable portion are in the first state.

3. The container of claim 2, wherein the cover body is pivoted to the barrel body, the sensing device further has a second magnetically attractable portion; wherein when the cover body is in the second position, the cover body and the barrel body are kept in a fixed relative position, the magnetic sensor is near the second magnetically attractable portion, and the magnetic sensor and the second magnetically attractable portion are in a second state; when the cover body receives an external force to move toward the barrel body, the magnetic sensor and the second magnetically attractable portion changes from the second state, the magnetic sensor transmits an electronic signal to the electronic processing unit, and the electronic processing unit drives the driving device to actuate the cover body to move from the second position to the first position.

4. The container of claim 3, wherein one of the cover body and the barrel body includes at least one pivot portion, the other of the cover body and the barrel body includes at least one axle, the at least one pivot portion and the at least one axle are pivoted to each other; wherein at least one said pivot portion has the first and second magnetically attractable portions, and the magnetic sensor is disposed on one of the at least one axle and corresponds to the first and second magnetically attractable portions.

5. The container of claim 1, wherein the driving device includes a motor and a connecting member, the motor is electrically connected to the electronic processing unit, the connecting member is connected to the motor and the cover body; wherein when the sensing device changes from the first state, the motor drives the connecting member to move toward the placement opening, the cover body swings relative to the barrel body with a side of the cover body connected to the connecting member as an rotation axle, and the cover body is lifted and moved to the second position.

6. The container of claim 1, wherein the cover body has a base and a touching portion, the touching portion is connected to the base and for receiving the external force so as to make the sensing device to change from the first state.

7. The container of claim 6, wherein the touching portion is detachably connected to the base and has a washable layer.

8. The container of claim 6, wherein at least a part of the touching portion protrudes radially beyond the barrel body.

9. The container of claim 1, further including a timer which is electrically connected to the electronic processing unit, the timer is preset with a predetermined period, when the cover body is in the second position, the timer starts to count, and when the timer reaches the predetermined period, the electronic processing unit drives the driving device to actuate the cover body to move from the second position to the first position.

10. The container of claim 9, further including a time adjusting member which is for being operated from outside, the time adjusting member arranged on the main body and electrically connected to the electronic processing unit, when the time adjusting member is actuated, the electronic processing unit changes the predetermined period; the sensing device having a first magnetically attractable portion and a magnetic sensor, one of the first magnetically attractable portion and the magnetic sensor being arranged on the barrel body, the other of the first magnetically attractable portion and the magnetic sensor being arranged on the cover body, and the magnetic sensor being electrically connected to the electronic processing unit; wherein when the cover body is in the first position, the magnetic sensor is near the first magnetically attractable portion, and the magnetic sensor and the first magnetically attractable are in the first state; the cover body having a base and a touching portion, the touching portion being connected to the base and for receiving the external force so as to make the magnetic sensor and the first magnetically attractable portion to change from the first state; the touching portion being detachably connected to the base and has a washable layer; at least a part of the touching portion protruding radially beyond the barrel body; the touching portion being substantially C-shaped; the driving device including a motor and a connecting member, the motor being electrically connected to the electronic processing unit, the connecting member being connected to the motor and the cover body; wherein when the magnetic sensor and the first magnetically attractable portion change from the first state, the motor drives the connecting member to move toward the placement opening, the cover body swings relative to the barrel body with a side of the cover body connected to the connecting member as an rotation axle, and the cover body is lifted and moved to the second position; the predetermined period being 5 seconds; the power connecting device being a battery box; the timer and the electronic processing unit being electrically connected to a circuit board; the barrel body further including a partition member, the partition member partitioning an interior of the barrel body into a first space and a second space, the first space communicating with the placement opening, the magnetic sensor, the electronic processing unit, the power connecting device and the driving device being received in the second space, and the first space being between the cover body and the second space.

* * * * *